US005114133A

United States Patent [19]

Osada et al.

[11] Patent Number: 5,114,133

[45] Date of Patent: May 19, 1992

[54] AUTOMATIC SHEET FEEDING DEVICE

[75] Inventors: Tokihiro Osada; Masao Aono, both of Kofu, Japan

[73] Assignee: Nippon Seimitsu Kogyo Kabushiki Kaisha, Kofu, Japan

[21] Appl. No.: 600,177

[22] Filed: Oct. 19, 1990

Related U.S. Application Data

[63] Continuation of Ser. No. 259,530, Oct. 19, 1988, abandoned.

[51] Int. Cl.[5] ..... B65H 3/30

[52] U.S. Cl. ..... 271/22; 271/121; 271/127; 271/171

[58] Field of Search ..... 271/21, 22, 121, 171, 271/127

[56] References Cited

U.S. PATENT DOCUMENTS 4,548,397 10/1985 Rünzi ..... 271/122 X
4,772,007 9/1988 Kashimura ..... 271/22
4,780,740 10/1988 Fukae ..... 271/171 X
4,838,535 6/1989 Yokoi ..... 271/171 X

FOREIGN PATENT DOCUMENTS 63-31037 2/1988 Japan .
63-96042 6/1988 Japan .

*Primary Examiner*—Richard A. Schacher
*Attorney, Agent, or Firm*—Oblon, Spivak, McClelland, Maier & Neustadt

[57] ABSTRACT

A first sheet stacker in which first sheets are stacked and retained by sheet separation claws is formed by a pair of first stacker forming members, and otherwise, a second sheet stacker free from the sheet separation claws is formed by placing second stacker forming members in between the first stacker forming members. Thus, the sheets different in size and thickness can be properly stacked in a single sheet stacker and selectively sent one by one to a printing apparatus such as a general purpose printer without use of any auxiliary sheet cassette or stacker.

1 Claim, 6 Drawing Sheets 20
50
24
36
56
26a
28a
22a
40a'
27a
54
53
41
52
40a
43a
42a
30a
32a
31a
ℓ1
ℓ2
30b
31b
32b
42b
40b
43b
40b'
28b
27b
26b
12
11
51

AUTOMATIC SHEET FEEDING DEVICE

This application is a continuation of application Ser. No. 07/259,530, filed on Oct. 18, 1988, now abandoned.

BACKGROUND OF THE INVENTION

1. Field of the Invention

This invention relates to an automatic sheet feeding device for properly feeding sheets different in size and thickness one by one to various types of printing apparatuses such as a general purpose printer, a facsimile machine, and a copying machine, and more particularly, to an automatic sheet feeding device having a single sheet feeding stacker capable of selectively stacking either of two kinds of sheets of different type in size and thickness, i.e. an ordinary typing or copying paper being relatively thin and a postcard being relatively thick, and automatically feeding the sheets thus stacked to the printing apparatus one by one.

2. Description of the Prior Art

There are a variety of sheet feeding devices for automatically feeding sheets of plastic, paper or the like one by one to a printing apparatus such as a general purpose printer for printing data outputted from a wordprocessor, computer, etc. and facsimile and a copying machine. Typical of these sheet feeding devices capable of stacking stacks of sheets different in size is a sheet feeding stacker having two or more paper bins and adapted to feed the sheets stacked thereon to a printing portion of the printer one by one, and a sheet ejecting stacker for holding printed sheets discharged from the printer. In order to feed the sheets stacked in the sheet stacker to the printer one by one, there has been generally adopted a mechanism composed of one or more sheet feed rollers which are in contact with the uppermost one of the stacked sheets in the sheet feeding stacker and a pair of sheet separation claws striking against the forward top corners of the stacked sheets. Upon reception of a sheet feeding instruction from the printer, the sheet feeding device is operated to rotate the sheet feed rollers so as to send out the uppermost one of the stacked sheets toward the printer. At this time, though the forward corners of the uppermost sheet are pressed with the separation claws, the uppermost sheet is flexibly bent while being retained by the separation claws, and then sprung to be released from the separation claws by rotating the sheet feed rollers in the sheet feeding direction. As a result, only one sheet thus released can be sent out toward the printing portion of the printer. Such a mechanism for feeding sheets one by one by use of the sheet separation claws can be applied to a relatively thin sheet such as ordinary copying or typing paper, but is awkward in dealing with a relatively thick, stiff sheet such as a postcard and cardboard. If the sheet feed rollers, which are in touch with the uppermost of such stiff sheets stacked on the sheet feeding stacker and held by the separation claws as noted above, is rotated in the sheet feeding direction in order to thrust the aforesaid uppermost sheet forward, the uppermost sheet cannot be flexibly released from the sheet separation claws because of its stiffness. When the sheet is forcibly thrust forward by rotating the sheet feed rollers in the sheet feeding direction, it will suffer a disadvantage in that the forward corner portions of the uppermost sheet are folded or damaged. Therefore, so far there have been properly used a mechanism having sheet separation claws as noted above for feeding a relatively thin, flexible sheet and a mechanism having a sheet through gap means for permitting one relative thick, stiff sheet to pass therethrough. That is to say, a conventional sheet feeding system as disclosed in Japanese Patent Application Public Disclosure SHO 63(1988)-60830(A), for example, adpts an auxiliary sheet cassette capable of containing a stack of thick sheets. This sheet cassette is provided with a sheet separation mechanism composed of a sheet pass through gap means as discussed above and can be detachably fitted in a standard sheet stacker integrally formed in the sheet feeding system. Otherwise, as seen in a conventional copying machine, there have been selectively used a standard sheet cassette for containing relatively thin sheets such as a copying paper and another sheet cassette for containing relatively thick sheets such as a postcard. That is, a sheet separation means for each cassette is different. Thus, the conventional sheet feeding device necessitates at least two sheet cassettes or stackers for stacking different sorts of sheets and calls for the troblesome work of exchanging the sheet cassettes particularly when being applied to the sheet different in thickness. Though there has hitherto been an idea of combining a sheet stacker for a thin sheet with a sheet stacker for a thick sheet, a mechanism having both the sheet stackers becomes complicated in structure and cannot be expected to be stably operated.

SUMMARY OF THE INVENTION

An object of this invention is to provide an automatic sheet feeding device having a single sheet stacker capable of selectively stacking thereon either of relatively thin, flexible sheets such as a typing paper and relatively thick, stiff sheets such as a postcard and properly feeding the sheets one by one, which device is simple in structure and easy to handle.

To attain the object described above according to this invention, there is provided an automatic sheet feeding device comprising a pair of first stacker forming members so as to define a first sheet stacker for holding a stack of first sheets, sheet separation claws disposed at the forward end portions of the first stacker forming members so as to press down the forward top corners of the first sheets stacked in the first sheet stacker, a pair of second stacker forming members disposed in between the first stacker forming members so as to define a second sheet stacker for holding a stack of second sheets each being thicker than the first sheet and having a function of making the separation claws ineffective, at least one sheet pass through gap member for permitting one second sheet to pass therethrough, and at least one sheet feed roller for feeding the first or second sheets one by one.

In a case that the first sheets being relatively thin are stacked in the first sheet stacker, the second stacker forming members between which the second sheet stacker is formed are evacuated so that the forward top corners of the first sheets stacked in the first sheet stacker are pressed down by the sheet separation claws. In this condition, by rotating the sheet feed roller, the uppermost one of the first sheets stacked in the first sheet stacker is flexibly bent and then sprung so as to be released from the sheet separation claws. As a result, only one sheet is sent out toward a printing apparatus through a gap formed in the sheet pass through gap member. In the case where the second sheet having a slightly larger thickness than that of the first sheet is fed to the printing apparatus, the second stacker forming members are placed in between the first stacker forming members so that the second sheets held by the second stacker forming members are not obstructed by the sheet separation claws. Then, by rotating the sheet feed roller in the sheet feeding direction, one second sheet can be sent out toward the printing apparatus through the sheet pass through gap member.

The aforementioned second stacker forming members may be removably or slidably disposed in a lateral direction.

The features of the present invention which are believed to be novel are set forth with particularity in the appended claims. The present invention, both as to its organization and manner or operation, together with further objects and advantages thereof, may best be understood by reference to the following description, taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
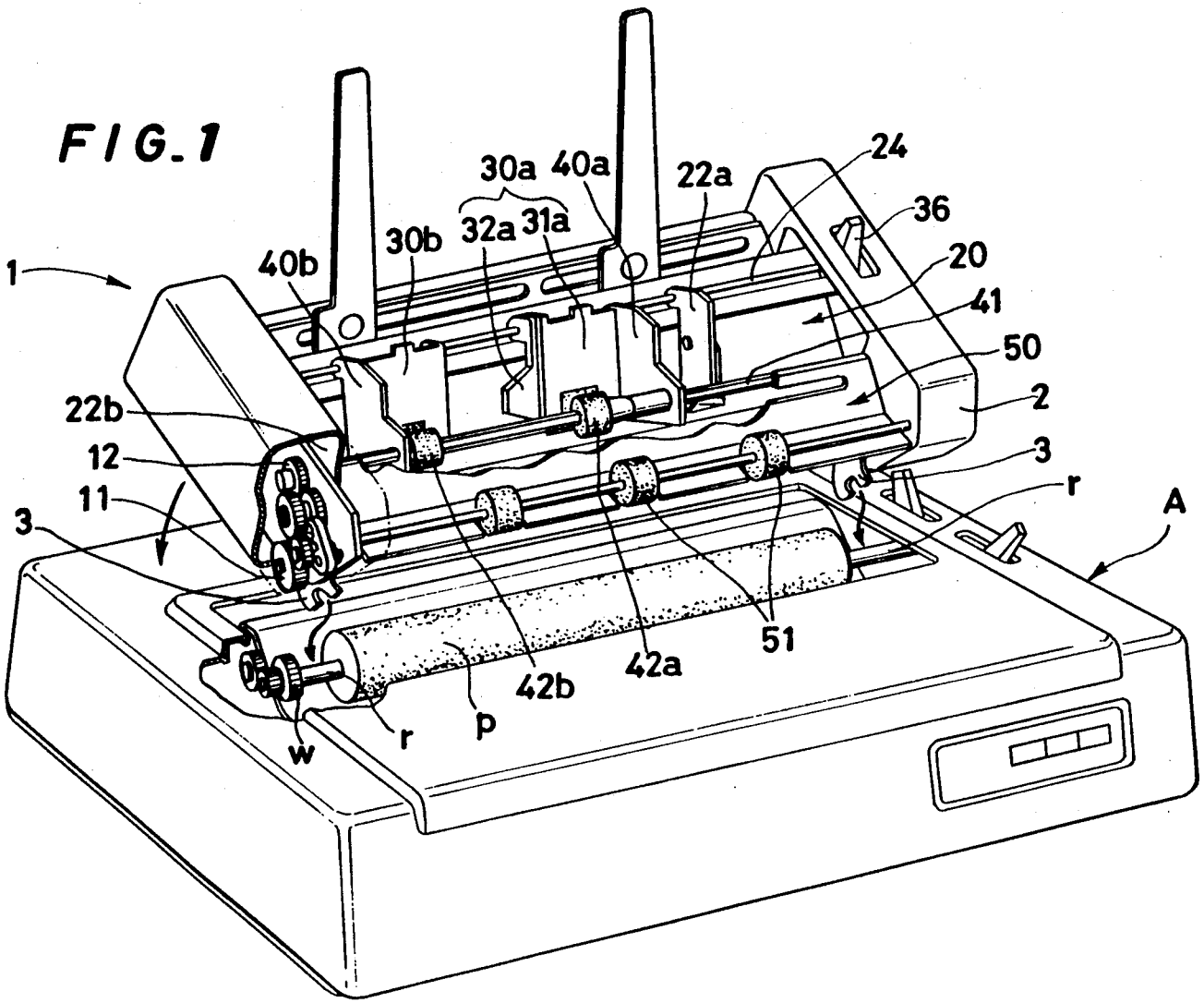
FIG. 1 is an explanatory diagram showing the manner in which a sheet feeding device according to this invention is mounted on a printer.

The automatic sheet feeding device according to the present invention can be integrally incorporated within or detachbly mounted on a facsimile, a copying machine, and a printing apparatus such as a general purpose printer to be connected to a wordprocessor, computer, etc. By way of example, there will be explained with reference to FIG. 1 the sheet feeding device denoted by numeral 1 in the drawing, which is detachably mounted onto the printer A. However, the structure of the printer and the means for coupling the sheet feeding device 1 with the printer A are not particularly limited.

FIG. 1 shows how the sheet feeding device 1 according to the present invention is attached to the printer A. The sheet feeding device 1 can be readily attached to the printer A only by being placed on the printer A while fitting retainer means 3 extending downward from the lower portion of a frame 2 of the sheet feeding device 1 to a rotary shaft r of a platen p of the printer A. At this time, an input-stage gear 11 of a driving system of the sheet feeding device 1 is engaged with a gear w fixed on the rotary shaft r of the printer A so that the sheet feeding device 1 is driven by utilization of a driving force generated by the printer A. The engagement of the gear 11 in the sheet feeding device 1 and the gear w in the printer A can be easily made merely by placing the sheet feeding device 1 on the printer A.

Figure 2:
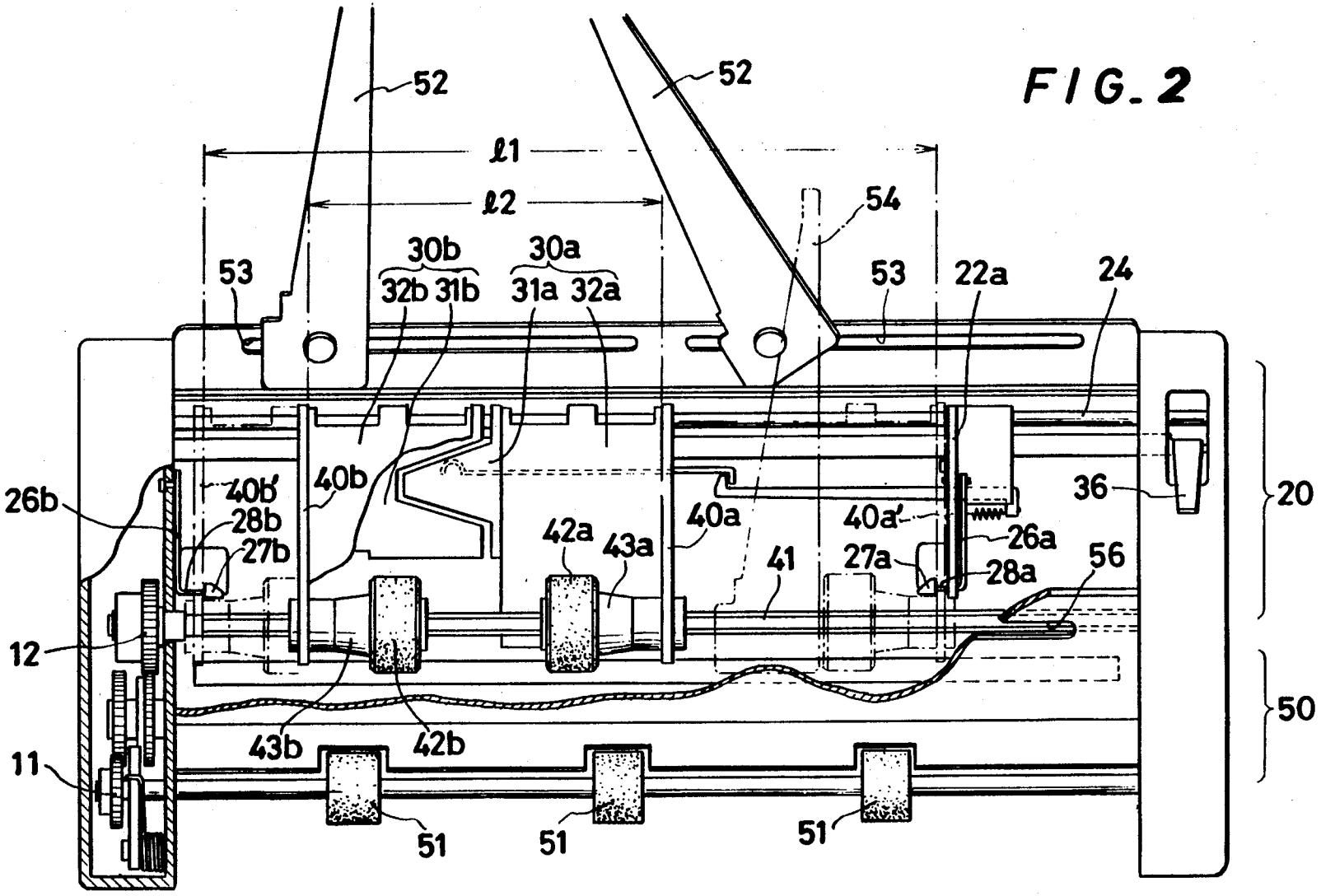
FIG. 2 is a partially sectioned plan view showing one embodiment of the device according to this invention.
Figure 3:
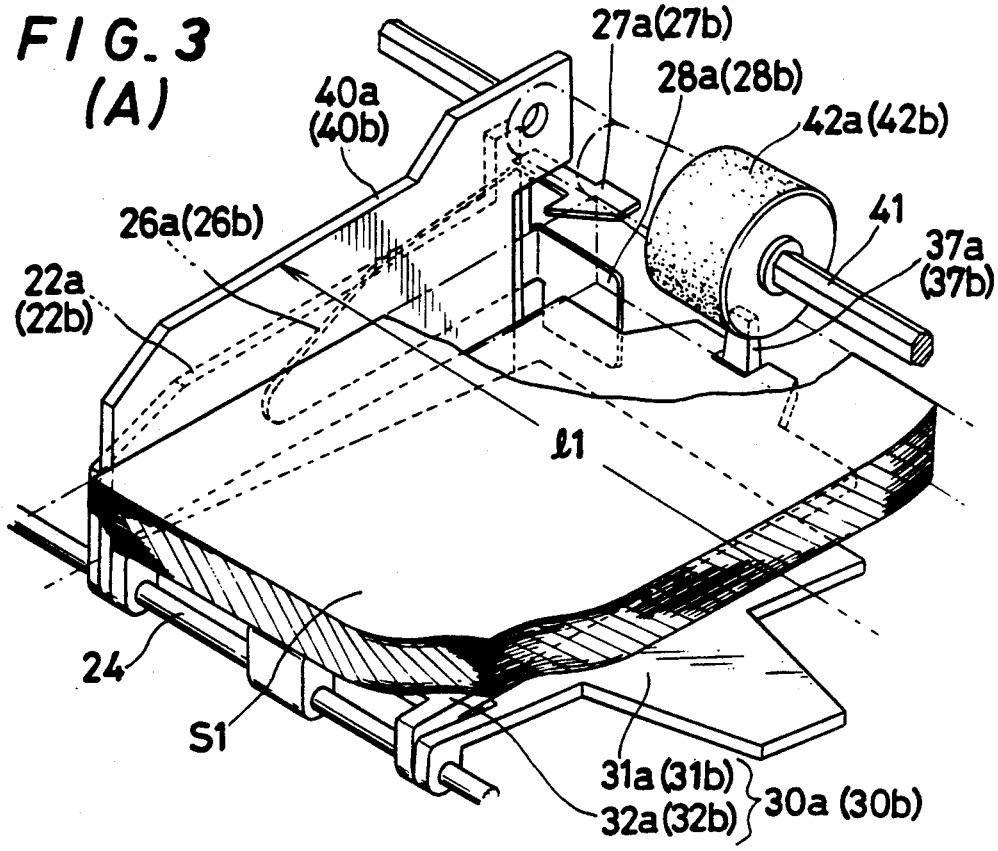
FIGS. 3(A) and 3(B) are partially sectioned, enlarged perspective views each illustrating a sheet feeding stacker of the device of this invention.
Figure 3:
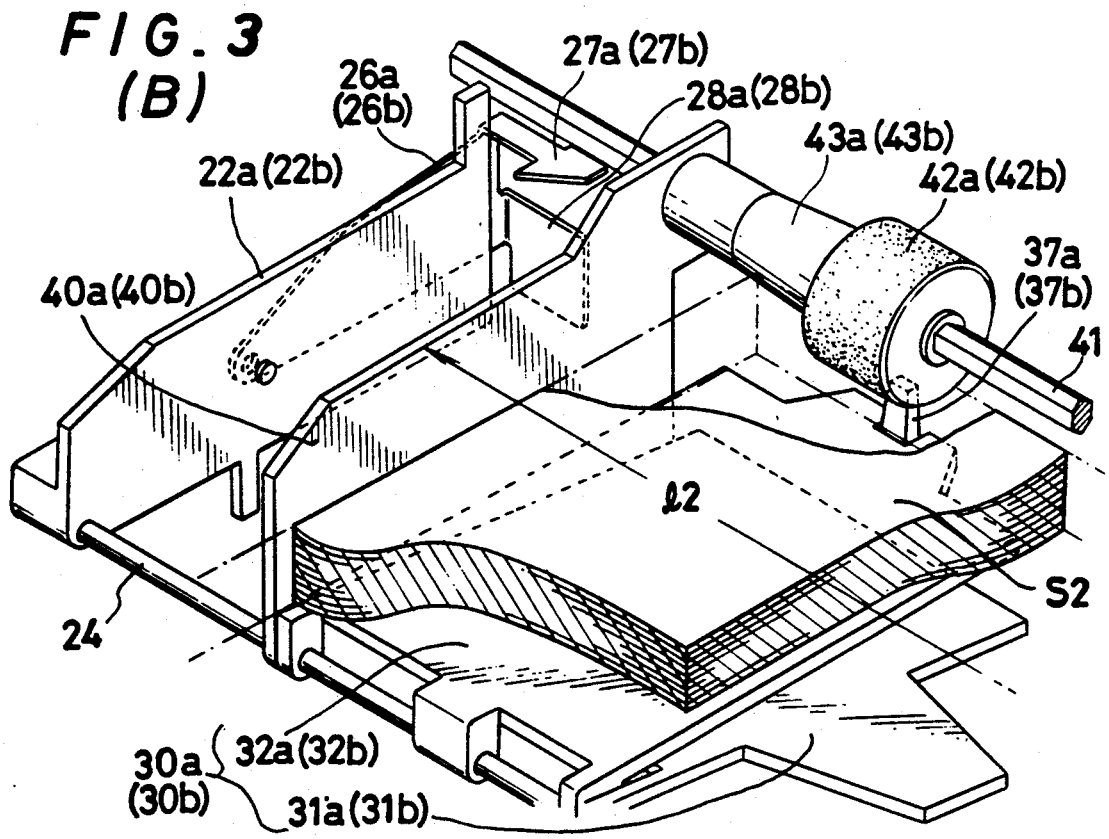
Figure 4:
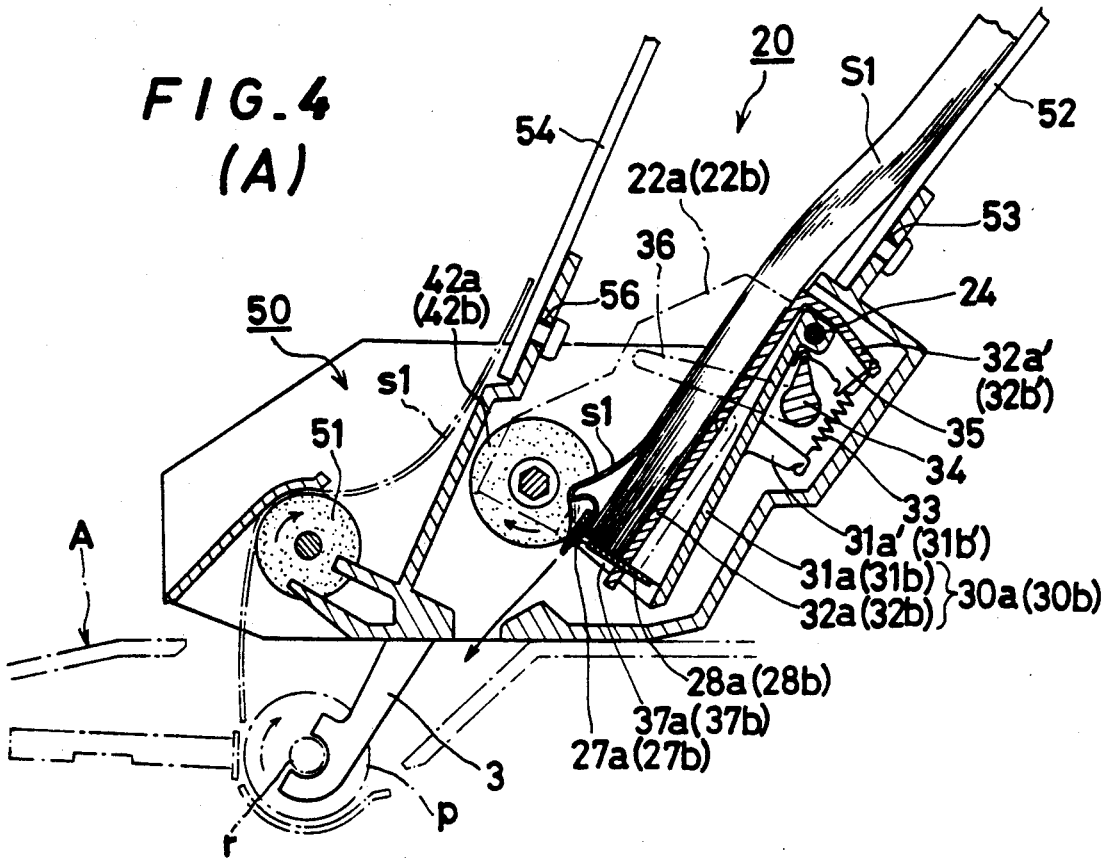
FIGS. 4(A) and 4(B) are sectioned side views each showing the sheet feeding stacker of the device of this invention.
Figure 4:
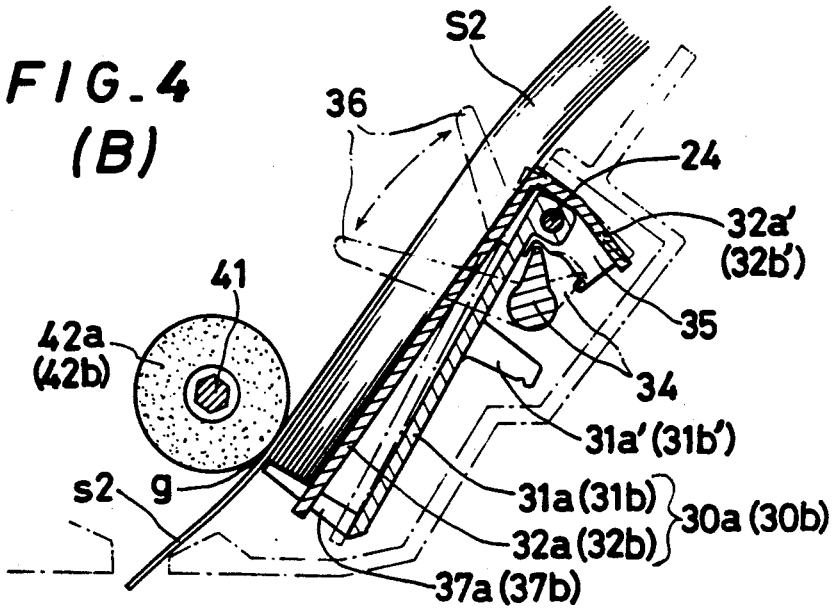

One preferred embodiment of the sheet feeding device 1 according to this invention is illustrated in FIGS. 2 to 4. In the drawings, numeral 20 denotes a sheet feeding stacker in which a stack of sheets to be fed to the printer A are stacked. The sheet feeding device 1 according to this invention has a function of properly holding and feeding two sorts of sheets different in size and thickness by use of a single sheet stacker. One sort of the sheets to be applied to the sheet feeding device of this invention is of a relatively thin, flexible sheet such as an ordinary copying or typing paper (hereinafter referred to as a "first sheet s1" or a "first sheet stack S1"). Another sort of sheet is of a relatively thick, stiff sheet such as a postcard (hereinafter referred to as a "second sheet s2" or a "second sheet stack S1").

The sheet feeding stacker 20 is provided with a pair of first stacker forming members 22*a*, 22*b* between which a first sheet stacker 11 is formed for holding the first sheet stack S1.

The first stacker forming member 22*a* is supported slidably by a guide shaft 24 extending in the width direction of the device 1. In this embodiment, the first stacker forming member 22*b* opposite to the member 22*a* is formed of the stationary side wall of the frame 2 of the device 1. The movable first stacker forming member 22*a* has a sheet separation lever 26*a* which is pivotally supported so that it can rockingly move in the vertical direction, as illustrated in FIG. 3(A). The sheet separation lever 26*a* is provided on its free end portion with a sheet separation claw 27*a* and a sheet stack retaining piece 28*a* beneath the sheet separation claw 27*a*. Likewise, the stationary first stacker forming member 22*b* has a sheet separation lever 26*b* having the same structure as the sheet separation lever 26*a*. That is, the sheet separation lever 26*b* is pivotally supported by the first stacker forming member 22*b* and provided on its free end portion with a sheet separation claw 27*b* and a sheet stack retaining piece 28*b*. Thus, in such a condition that the sheet stack S1 is placed in the first sheet stacker (1 defined between the first stacker forming members 22*a* and 22*b*, the forward corners of the sheet stack S1 are pressed down and held by the sheet separation claws 27*a*, 27*b*.

Between the first stacker forming members 22*a* and 22*b*, there are disposed sheet beds 30*a*, 30*b* on which either of the sheet stacks S1 and S2 is selectively placed. The sheet beds 30*a*, 30*b* have bottom plates 31*a*, 31*b* supported slidably by the guide shaft 24 and base plates 32*a*, 32*b* which are rockingly movable up and down on the bottom plates 31*a*, 31*b*.

As illustrated in FIG. 4(B), the base plate 32*a* (32*b*) is rotatable about the guide shaft 24 and kept upwardly energized by a spring 33 held between a hook piece 31*a*' (31*b*') projecting downward from the bottom plate 32*a* (31*b*) and a hook portion 32*a*' (32*b*') extending downward from the base plate 32*a* (32*b*). In parallel to the guide shaft 24, there is arranged a cam rod 34. On the other hand, on the lower surface of the base plate 32*a* (32*b*), a cam member 35 is formed opposite to the cam rod 34. Furthermore, the cam rod 34 is provided on its one end with a cam lever 36 so that the base plate 32*a* (32*b*) can move downward against the spring 33 by operating the cam lever 36 as illustrated in FIG. 4(B). Thus, when the base plate 32*a* (32*b*) comes down, the sheet stack can be placed in between a sheet feed roller 42a (42b) and the base plate 32a (32b).

On the side portions of the sheet beds 30a, 30b there are stood second stacker forming members 40a, 40b having a function of making the sheet separation claws 27a, 27b ineffective. These second stacker forming members 40a, 40b are slidably held by the guide shaft 24 and a rotary shaft 41 which is driven to rotate by a final-stage gear 12 in the driving system 10 through which the driving force produced by the printer A is transmitted to the rotary shaft 41. Thus, the second stacker forming members 40a, 40b can be slidably moved along the guide shaft 24 and the rotary shaft 41 in the width direction of the device. When the second stacker forming members 40a, 40b are brought into face contact with the respective first stacker forming members 22a, 22b as indicated by a chain line in FIG. 2, the first sheet stacker l1 can be formed for holding the first sheet stack S1. The distance between the first stacker forming members 22a, 22b, i.e. the width of the first sheet stacker l1, can be freely varied by moving the first sheet stacker forming member 22a along the guide shaft 24 in accordance with the width of the sheed stack S1. Thus, in a case that the first sheet stack S1 is stacked in the first sheet stacker l1, the forward corners of the sheet stack S1 are pressed down by the sheet separation claws 27a, 27b disposed on the first stacker forming members 22a, 22b, as partially illustrated in FIG. 3 (A).

When the second stacker forming members 40a, 40b are moved inwardly to be separated from the first stacker forming members 22a, 22b as indicated by a solid line in FIG. 2, the second sheet stacker l2 for holding the second sheet stack S2 is formed between the second stacked forming members 22a and 22b. In this state, the second sheet stack S2 is free from the sheet separation claws 27a, 27b disposed on the first stacker forming members 22a, 22b because the second stacker forming members 40a, 40b are kept apart from the first stacker forming member 22a, 22b, as partially illustrated in FIG. 3(B). By moving the second stacker forming members 40a, 40b relative to each other, the width of the second sheet stacker l2 can be freely varied in accordance with the width of the second sheet stacker S2.

The rotary shaft 41 has sheet feed rollers 42a, 42b disposed opposite to the respective sheet beds 30a, 30b and connected to the respective second stacker forming members 40a, 40b by means of connector members 43a, 43b. Since the rotary shaft 41 has a non-circular section, the sheet feed rollers 42a, 42b are slidable along and rotable with the rotary shaft 41. As will be understood from FIGS. 3(A) and 3(B), the sheet feed rollers 40a, 40b come into contact with the uppermost one of the sheets stacked into the sheet stacker. Therefore, when the sheet feed rollers 42a, 42b are rotated by the driving force transmitted from the printer A via the driving system, the uppermost one of the sheets stacked in the sheet stacker is sent toward a printing portion around the platen of the printer A as illustrated in FIGS. 4(A) and 4(B).

On the forward end portions of the bottom plates 31a, 31b, there are stood sheet through gap members 37a, 37b extending toward the sheet feed rollers 42a, 42b. Between each top end of the gap members 37a, 37b and the respective sheet feed rollers 42a, 42b, there is formed a gap q for allowing one second sheet s1 to pass therethrough, but checking the passing of two second sheets lying one upon another as is apparent from the illustration of FIG. 4(B).

Next, a mechanism for feeding the sheets stacked in the sheet stacker one by one toward the printer A will be explained.

In the case that the first sheets s1 held by the first sheet stacker l1 are fed one by one toward the printer A, the second stacker forming members 40a, 40b are brought in face contact with the respective first stacker forming members 22a, 22b so as to form the first sheet stacker l1. Then, the first sheet stack s1 is stacked in the first sheet stacker (1 and held down at the forward corners thereof by the sheet separation claws 27a, 27b as illustrated in FIGS. 3(A) and 4(A). In this state, by rotating the sheet feed rollers 40a, 40b in the sheet feeding direction, only the uppermost sheet of the sheet stack S1 which is in direct contact with the sheet feed rollers 40a, 40b, is flexibly sprung to be released from the sheet separation claws 27a, 27b and sent out toward the printer A while preventing the entire sheet stack S1 form being pushed forward by means of the sheet stack retaining pieces 28a, 28b.

In the case of feeding the relatively thick, stiff second sheet s2 such as a postcard with the rotation of the sheet feed rollers 42a, 42b, the second stacker forming members 40a, 40b are moved to be separated from the respective first stacker forming members 22a, 22b so as to form the second sheet stacker l2. Though the second sheet s2 cannot be flexibly released from the separation claws 27a, 27b, it can be sent out toward the printer A because the second stacker forming members 40a, 40b are respectively separated from the sheet separation claws 27a, 27b. That is, when the sheet feed rollers 42a, 42b are driven to rotate, only the uppermost sheet of the sheet stack S2 is sent out to pass through the gap q between the respective gap members 37a, 37b and the sheet feed rollers 42a, 42b. At this time, even if two sheets s2 together move with the rotation of the sheet feed rollers 42a, 42b, only one sheet s2 is allowed to pass through the gap q formed between the sheet pass through gap members 37a, 37b and the sheet feed rollers 42a, 42b because the gap q is larger than the thickness of one sheet s2, but smaller than two times the thickness of the sheet s2, as illustrated in FIG. 4(B). As mentioned above, the sheets stacked in the sheet stacker can be exactly fed one by one toward the printer A with the rotation of the sheet feed rollers 42a, 42b without regard to the thickness of the sheet to be fed.

In the drawings, by numeral 50 is denoted a sheet ejecting stacker which serves to hold a printed sheet discharged from the printer A upon completion of printing and is located at the front portion of the sheet feeding device 1. The printed sheet from the platen p of the printer A is sent to the sheet ejecting stacker 50 with the aid of guide rollers 51 as illustrated in FIG. 4(A). Numeral 52 denotes collapsible sheet supports which are disposed on the sheet feeding stacker 20 for supporting the sheets stacked in the sheet feeding stacker 20 in such a state that it can be slidably moved along guide slots 53. Numeral 54 denotes collapsible sheet supports which are disposed on the sheet ejecting stacker 50 for supporting the printed sheets discharged from the printer A upon completion of printing in such a state that it can be slidably moved along guide slots 56.

As is apparent from the foregoing, according to this invention, sheets different in size and thickness can be properly stacked into the aforementioned single sheet feeding stacker 20 and selectively sent out one by one toward the printer A without use of any auxiliary stacker means. Thus, the automatic sheet feeding device according to this invention is basically composed of the single stacker 20 capable of selectively forming the first sheet stacker 11 for stacking the relatively thin sheets and the second sheet stacker 12 for stacking the relatively thick sheets. Other preferred embodiments having the basic structure noted above will be described hereinafter with reference to FIGS. 5 to 8. In these figures, the elements indicated by like numerals with respect to those of the first embodiment have analogous structures and functions to those of the first embodiment and will not be described in detail again.

Figure 5:
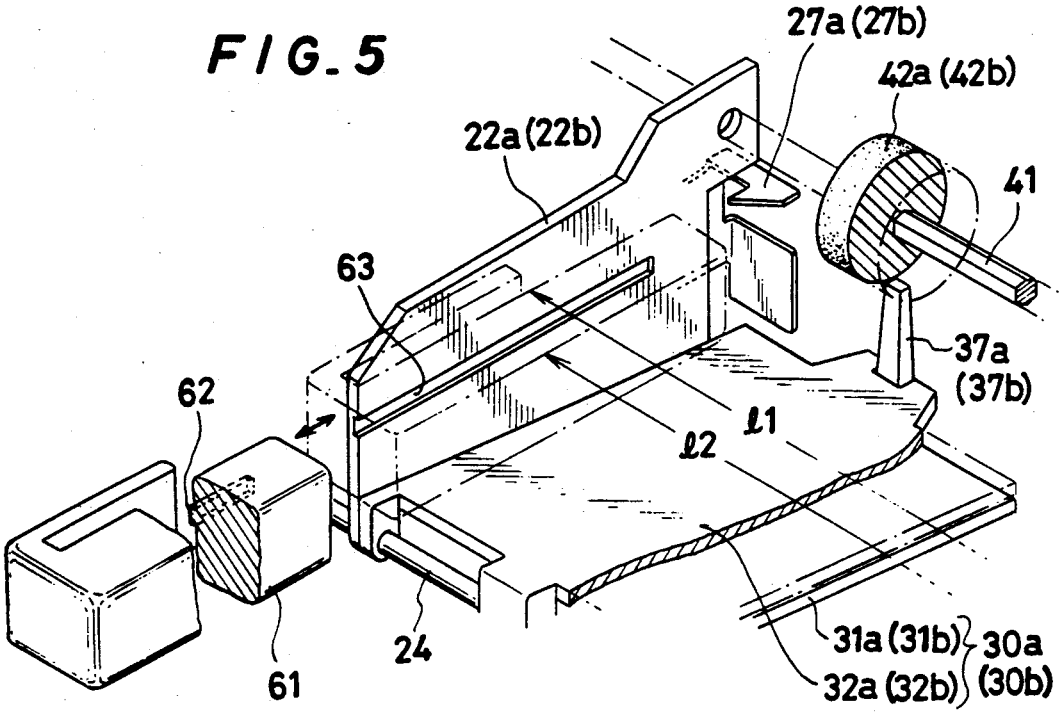
FIG. 5 is a partially enlarged perspective view of a second embodiment of this invention.

In a second embodiment shown in FIG. 5, the second stacker forming member is formed of a substantially U-shaped spacer block 61. The spacer block 61 is detachably fitted to the first stacker forming member 22*a* (22*b*) in such a state that the first stacker forming member is held in the spacer block 61. The spacer block 61 has a width slightly larger than the length of the sheet separation claw 27*a* (27*b*) projecting laterally from the first stacker forming member 22*a* (22*b*) so that the second stacker (2 formed between the second stacker forming members 40*a* and 40*b* is not obstructed by the sheet separation claws 27*a*, 27*b* when the spacer blocks 61 are attached to the first stacker forming members 22*a*, 22*b*. The spacer block 61 is provided with a guide rib 62 to be slidably fitted in a guide groove 63 formed in the first stacker forming member 22*a* (22*b*). Thus, when the spacer blocks 61 are removed, the first sheet stacker (1 in which the first sheet stack S1 stacked thereon is held by the sheet separation claws 27*a*, 27*b* is formed between the first stacker forming members 22*a* and 22*b*. On the other hand, when the spacer blocks 61 are attached to the first stacker forming members 22*a*, 22*b*, the second sheet stacker 12 in which the second sheet stack S2 is free from the sheet separation claws 27*a*, 27*b* is formed between the spacer blocks 61 serving as the second stacker forming members. In this embodiment, the sheet bed 30*a* (30*b*) consisting of the bottom plate 32*a* (31*b*) and the base plate 32*a* (32*b*) is integrally formed with the first stacker forming member 22*a* (22*b*).

Figure 6:
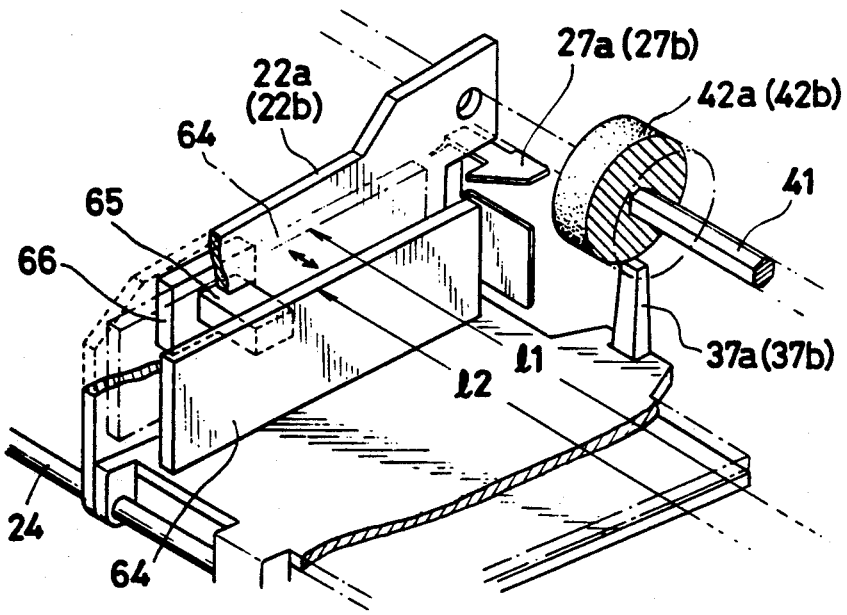
FIG. 6 is a partially enlarged perspective view of a third embodiment of this invention.

In a third embodiment shown in FIG. 6, the second stacker forming member is formed of a stacker forming plate 64 disposed so as to be reciprocally movable relative to the first stacker forming member 22*a* (22*b*). The stacker forming plate 64 has a push rod 65 penetrating the first stacker forming member 22*a* (22*b*) and a push plate 66 formed on the outside end of the push rod 65. The push rod 65 has a length slightly larger than that of the sheet separation claw 27*a* (27*b*) extending laterally from the sheet separation lever 26*a* (26*b*). Thus, when the stacker forming plates 64 disposed respectively on the first stacker forming members 22*a*, 22*b* are retreated to come in face contact with the first stacker forming members 22*a*, 22*b*, the first sheet stacker 11 is formed between the stacker forming plates 64. On the other hand, when the stacker forming plates 64 are pushed inward so as to be separated from the first stacker forming members 22*a*, 22*b*, the second sheet stacker 12 free from the sheet separation claws 27*a*, 27*b* is formed between the stacker forming plates 64.

Figure 7:
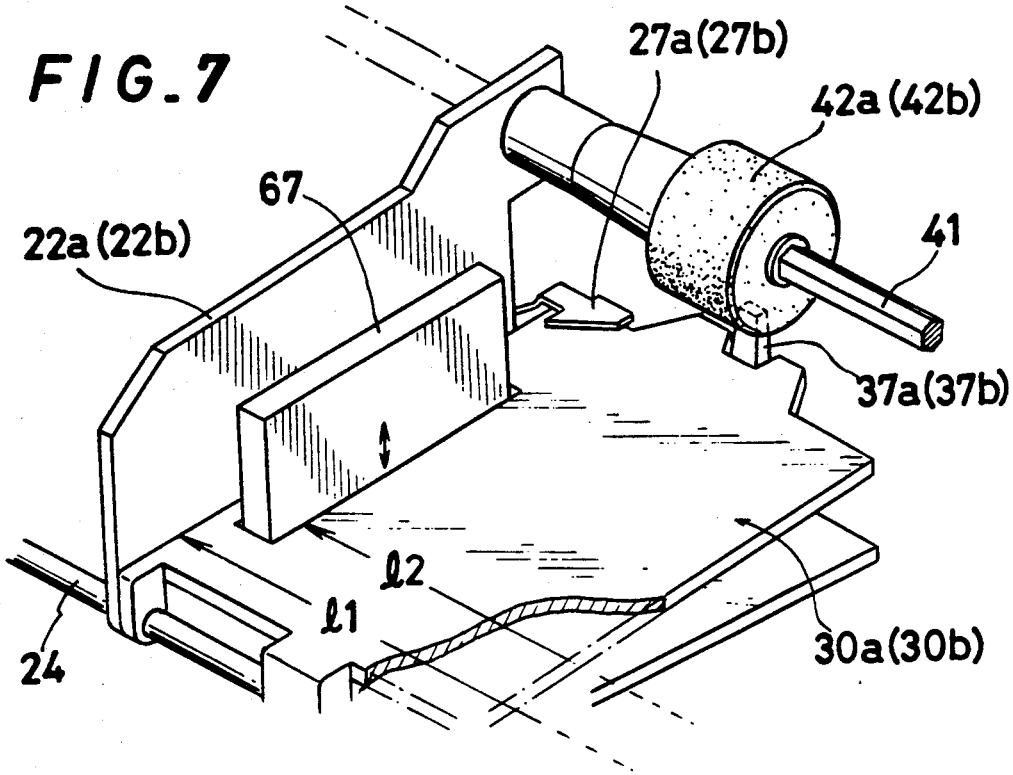
FIG. 7 is a partially enlarged perspective view of a fourth embodiment of this invention.

A fourth embodiment shown in FIG. 7 uses rising plates 67 as the second stacker forming members. The rising plate 67 is movable vertically so as to come up from below the sheet bed 30*a* (30*b*). In the state of sinking the rising plates 67 into the sheet beds 30*a*, 30*b*, the first sheet stacker 11 is formed. When the rising plates 67 rise, the second sheet stacker 12 free from the sheet separation claws 27*a*, 27*b* is formed.

Figure 8:
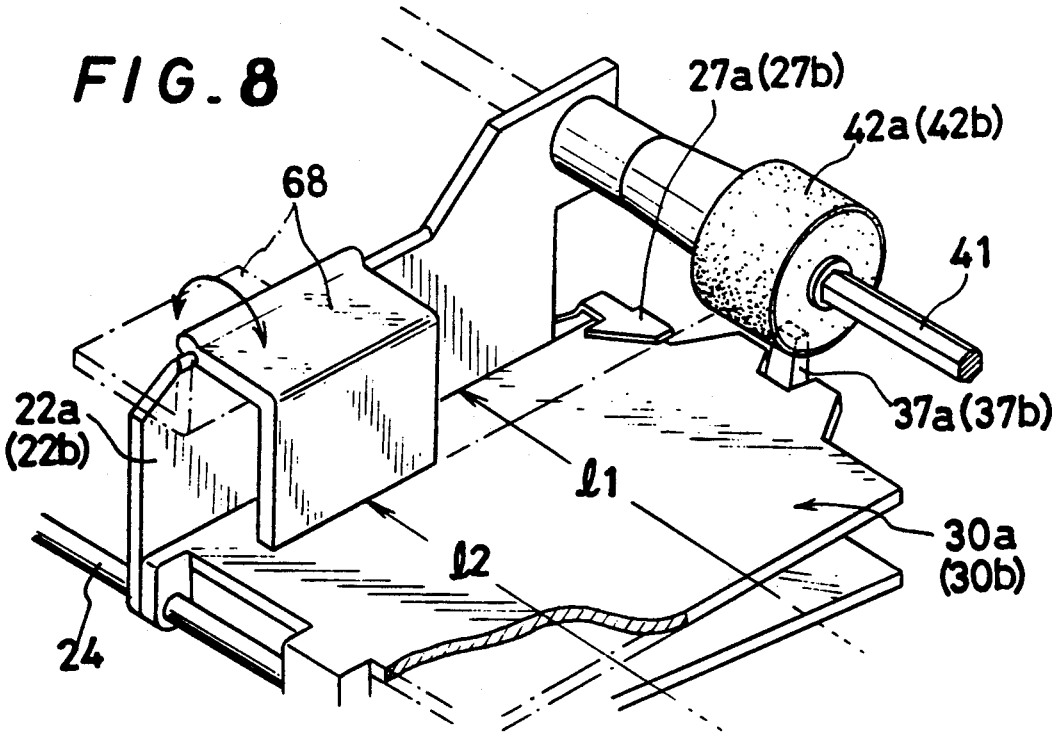
FIG. 8 is a partially enlarged perspective view of a fifth embodiment of this invention.

In a fifth embodiment shown in FIG. 8, angle members 68 are used as the second stacker forming members and rotatably disposed on the first stacker forming members 22*a*, 22*b*. When the angle members 68 are retreated outward as indicated by a chain line in FIG. 8, the first sheet stacker 11 is formed. When the angle members 68 are placed inside between the first stacker forming members 22*a* and 22*b*, the second sheet stacker 12 free from the sheet separation claws 27*a*, 27*b* is formed.

As is clear from the foregoing, according to the present invention, it is possible to provide an automatic sheet feeding device which can properly feed sheets different in thickness and size one by one to a printing apparatus such as a general purpose printer by use of only one sheet stacker without use of any auxiliary sheet cassette or stacker. Therefore, either of relatively thin sheets such as an ordinary typing or copying paper and relatively thick sheets such as a postcard can be selectively stacked in the sheet stacker with ease.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. An automatic sheet feeding device for selectively feeding relatively thin first sheets and relatively thick second sheets one by one, comprising:

a guide shaft extending widthwise, a rotary shaft rotatably retained parallel to said guide shaft, at least one sheet bed comprising at least one bottom plate slidably supported on said guide shaft and at least one base plate slidably supported by said guide shaft in a rockingly movable manner on said bottom plate, a pair of first stacker forming members disposed opposite to each other with side sheet bed positioned therebetween for forming a first sheet stacker to hold a stack of said first sheets, at least one of said first stacker forming members being movable laterally along said guide shaft, a pair of sheet separation claws provided on said first stacker forming members for pressing down forward corners of said first sheets stacked in said first sheet stacker, a pair of second stacker forming members placed in between the first stacker forming members for forming a second sheet stacker to hold a stack of said second sheets and slidably supported by said side guide shaft and rotary shaft so as to be movable laterally with respect to said first stacker forming member for making said sheet separation claws ineffective to thereby define a second sheet stacker for holding a stack of said second sheets when said second stacker forming members are separated from said first stacker forming members, at least one sheet feed roller fixed onto at least one of said second stacker forming members for feeding one of the first and second sheets one by one in one direction, and at least one sheet pass through gap member extending from said bottom plate toward said sheet fed roller and disposed relative to said sheet feed roller and said second stacker so as to form a gap with said sheet feed roller for permitting one of said second sheets to pass therethrough and preventing two or more of said second sheets lying one upon another from passing therethrough.

* * * * *

UNITED STATES PATENT AND TRADEMARK OFFICE

CERTIFICATE OF CORRECTION

PATENT NO. : 5,114,133

DATED : May 19, 1992

INVENTOR(S) : Tokihiro Osada et al.

It is certified that error appears in the above-identified patent and that said Letters Patent is hereby corrected as shown below:

Title page, item (63):

The Related U.S. Application Data is incorrect, should be,

--Continuation of Ser. No. 259,530, Oct. 18, 1988, abandoned--.

Signed and Sealed this

Sixth Day of July, 1993

Attest:

Michael K. Kirk

MICHAEL K. KIRK

Attesting Officer

Acting Commissioner of Patents and Trademarks